US005740639A

United States Patent [19]

Covington

[11] Patent Number: 5,740,639

[45] Date of Patent: Apr. 21, 1998

[54] DOUBLE PANEL STORM SHUTTER INSTALLATION WITH BRACE

[76] Inventor: James B. Covington, 3595 Lighthouse Dr., Palm Beach Gardens, Fla. 33410

[21] Appl. No.: 725,500

[22] Filed: Oct. 4, 1996

[51] Int. Cl.[6] ..... E06B 9/02

[52] U.S. Cl. ..... 52/202; 49/57; 49/62; 49/463; 52/204.6; 52/204.62; 52/656.7; 52/DIG. 12

[58] Field of Search ..... 49/50, 57, 61, 49/62, 463; 52/202, 203, 204.6, 204.62, 204.64, 206.65, 204.68, 317, 456, 473, 656.1, 656.2, 656.4, 656.6, 656.7, 667, 668, DIG. 12

[56] References Cited

U.S. PATENT DOCUMENTS

| | | | |
|---|---|---|---|
| 2,454,583 | 11/1948 | Wisely | 52/667 |
| 2,622,285 | 12/1952 | Roos . | |
| 2,877,840 | 3/1959 | Hurowitz et al. | 49/62 X |
| 3,224,048 | 12/1965 | Sullivan | 49/57 |
| 3,745,704 | 7/1973 | Covington . | |
| 3,768,224 | 10/1973 | Curtis | 52/668 |
| 3,835,586 | 9/1974 | Gates et al. | 49/463 |
| 4,215,517 | 8/1980 | Everson | 52/202 |
| 4,333,271 | 6/1982 | DePaolo et al. | 52/202 X |
| 4,685,261 | 8/1987 | Seaquist | 49/62 X |
| 5,335,452 | 8/1994 | Taylor . | |
| 5,347,775 | 9/1994 | Santos . | |
| 5,465,537 | 11/1995 | Fullwood | 52/202 |
| 5,477,646 | 12/1995 | Dietz . | |
| 5,509,239 | 4/1996 | Fullwood . | |
| 5,522,190 | 6/1996 | Fullwood | 52/202 |
| 5,524,403 | 6/1996 | Fullwood | 52/202 |
| 5,533,308 | 7/1996 | Fullwood | 52/656.7 X |
| 5,540,018 | 7/1996 | Biggers | 52/202 |

*Primary Examiner*—Carl D. Friedman
*Assistant Examiner*—Kevin D. Wilkens
*Attorney, Agent, or Firm*—G. Turner Moller

[57] ABSTRACT

A storm shutter installation includes a pair of supports attached above and below a window to be protected. The supports include a pair of parallel channels to receive a pair of plywood panels. One or more removable brace are provided to support the plywood panels. The braces typically run parallel to the short dimension of the panels thereby reducing the unsupported long dimension of the panels. The braces are clamped together, thereby clamping the panels together and clamping the panels to the supports. The resulting storm shutter installation is substantially stronger, perhaps as much as an order of magnitude, than single plywood panel installations.

19 Claims, 2 Drawing Sheets

FIG. 3
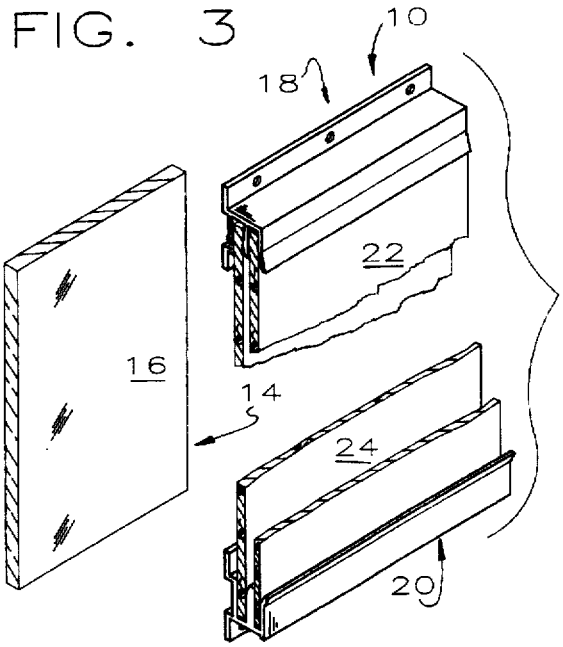
FIG. 4
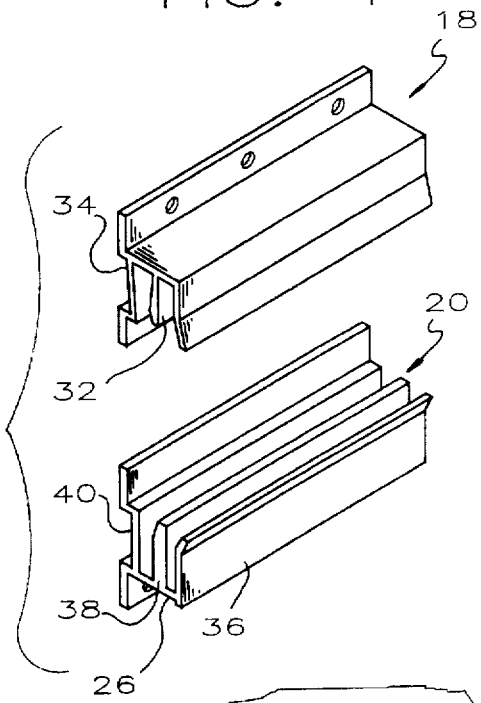
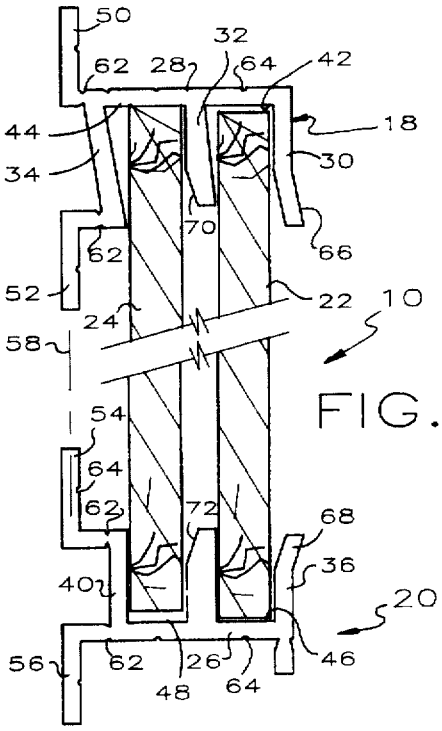
FIG. 2
FIG. 1
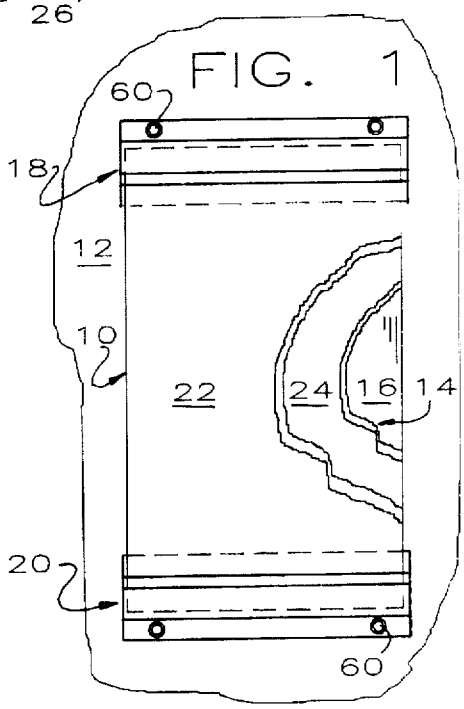

DOUBLE PANEL STORM SHUTTER INSTALLATION WITH BRACE

This invention is an installation for protecting windows during inclement weather, such as storms and hurricanes.

BACKGROUND OF THE INVENTION

The provision of storm shutters and the like for protecting a glass window during inclement weather is well known. The standard technique is to simply nail plywood over the exposed window. This has many disadvantages.

As might be expected, there are a number of sophisticated commercially available approaches to protect windows, glass doors and the like during storms, such as roll up shutters and the like. Some of these devices are priced so high as to be uneconomic in all but the most expensive homes.

U.S. Pat. No. 3,745,704 discloses aluminum extrusions shaped to receive and support a single removable plywood panel. The extrusions are attached above and below the window to be protected and define a pair of facing channels to receive the plywood panel. Although this approach is effective to a substantial degree, the resultant structure does not meet many newer codes, such as in South Florida.

Other disclosures of interest are found in U.S. Pat. Nos. 2,622,285; 5,335,452; 5,347,775; 5,477,646 and 5,509,239.

The Dade County, Florida code for window protective devices includes a test where a standard 8' stud (nominal 2"×4"×8' weighing 9.4 pounds) is shot from a device spaced 12' from the glass opening at a speed of 50 feet/second. The window protective covering must be at least 2" from the window glass and be sufficiently strong that it does not touch the window glass or glass frame in the above impact test. In addition, the window protective covering must be sufficiently strong to pass a wind-load test of 140 miles per hour. To pass these code tests requires a window covering of formidable strength.

SUMMARY OF THE INVENTION

In this invention, two or more window protective panels are received in parallel channels provided by supports near the upper and lower edges of the window to be protected. The protective panels are typically plywood but may be a tough transparent plastic such as LEXAN to provide visibility and light to overcome the feeling of claustrophobia experienced by many. The supports are conveniently aluminum extrusions and are connected to the building in one of a variety of techniques depending on the configuration of the building adjacent the window. The supports are installed with conventional tools available to knowledgeable workmen.

Angle members are fixed to the building adjacent the sides of the window protective panels and provide two important functions. First, they restrict air flow paths to the rear of the window protective panels thereby reducing the likelihood that high velocity wind gets behind the panels. Second, they provide vertical supports for one or more, and preferably two, removable horizontal bars restraining movement of the window protective panels toward and/or away from the window glass. The horizonal bars deter deflection of the panels toward the window glass and thus act as supports against rearward movement of the panel thereby effectively halving its maximum unsupported length.

After the supports and side rails have been installed, assembly of the window protective system of this invention requires no tools and can be done in a few minutes. The home-owner needs only to insert the first horizontal bar in its support slots and then position the window protective panels in their respective channels. The second horizontal bar is then inserted in its support slots. One or more thumb screws are then used to clamp the panels and the horizontal bars together. The result is a window protective covering of formidable strength.

It is an object of this invention to provide an improved window protective system.

A further object of this invention is to provide a window protective system providing two or more parallel protective panels removable received in channels in a permanent support.

Another object of this invention is to provide a window protective system providing side rails restricting air flow behind a window protective panel and to support and retain one or more removable horizontal bars deterring deflection of the panels toward the window.

These and other objects and advantages of this description will become more apparent as this description proceeds, reference being made to the accompanying drawings and appended claims.

BRIEF DESCRIPTION OF THE DRAWINGS

FIG. 1 is a front elevational view of the window protective system of this invention installed over a conventional window;

FIG. 2 is an enlarged broken side elevational view of the window protective system of FIG. 1;

FIG. 3 is a broken exploded isometric view illustrating the window protective system of FIGS. 1 and 2;

FIG. 4 is an enlarged isometric view of the panel receiving supports;

DETAILED DESCRIPTION

Figure 8:
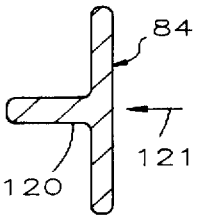
FIG. 8 is a cross-sectional view of the support bar of FIGS. 5–7.

Referring to FIGS. 1–4, a window protective system or installation 10 of this invention is positioned in front of a conventional opening, such as a door or window, in a building wall 12. Typically, the installation 10 protects a window 14 including a glass pane or panel 16. The installation 10 includes, as major components, upper and lower channel supports 18, 20 and a pair of structural panels 22, 24.

The upper and lower supports 18, 20 are quite similar but are not identical. The supports 18, 20 are conveniently aluminum extrusions providing a base 26, 28 from which extend a multiplicity of vertical walls 30–40 providing channels 42, 44, 46, 48 for receiving and supporting the structural panels 22, 24. As shown best in FIG. 2, the channels 42, 46 define a plane for receiving the front or outer panel 22 and the channels 44, 48 define a plane for receiving the rear or inner panel 24.

The supports 18, 20 also provide mounting flanges 50–56 for attaching the aluminum extrusions to the building wall 12. The flanges 50–56 lie in a common plane 58 and abut the building wall 12 to receive suitable fasteners 60 connecting the supports 18, 20 to the building wall. The supports 18, 20 provide weakened sections or break off points 62 for separating the mounting flanges 50–56 from the supports 18, 20 so the supports 18, 20 can be modified to fit the configuration of the building wall 12 around the window 14. Those skilled in the art will recognize that the flange 50, for example, can be broken off the support 18 by grasping the flange 50 with a pair of pliers and bending the flange in a counterclockwise direction. This breaks the flange 50 off the support at the break off point 62. In this manner, the supports 18, 20 can be modified to suit the configuration of the window 14 and the building adjacent thereto.

The supports 18, 20 also provide a series of score lines 64 for aligning the center of the leg to promote precise drilling of holes to receive threaded fasteners.

The ends of the walls 30, 32, 36, 38 bend or taper away from the plane 58 to facilitate placement of the structural panels 22, 24 in their respective channels 42, 46 and 44, 48 as will be more fully apparent hereinafter. This is seen best in FIG. 2 where the ends 66, 68 of the forward walls 30, 36 diverge away from the panel 22 and the intermediate walls 32, 38 provide a tapered sections 70, 72 diverging away from the panel 24. It will accordingly be seen that the intermediate walls 32, 38 of the upper and lower supports 18, 20 include a first inner section adjoining the base 28, 26 and generally parallel to the plane 58 and a second outer section 70, 72 adjoining the inner section and defining an acute angle with the plane 58. It will be seen that these features enlarge the mouth of the channels 42, 44, 46, 48 and allow the panels 22, 24 to move more easily into the channels.

The rear wall 34 of the upper channel 18 differs significantly from the rear wall 40 of the lower channel 20 and is at an angle more nearly parallel to the tapered section 70 than to the vertical. In other words, the angle of the inside surface of the rear wall 34 is between the angle of the tapered section and the angle of the rear surface of the intermediate wall 32.

It will be seen that the upper channels 42, 44 are deeper than the lower channels 46, 48. The upper channels 42, 44 must be of sufficient depth to receive the upper end of the panels 22, 24 during installation so the panels 22, 24 can clear the lower support 20 and still retain the panels 22, 24 when the panels 24 are lowered into the operating position shown in FIG. 2.

The panels 22, 24 may be of any suitable material. The least expensive practical material is plywood. A more expensive but very desirable material is a transparent or translucent polymer plastic material such as LEXAN. A transparent plastic material allows light inside the building and allows people to see outside. This minimizes the feeling of claustrophobia that affects some people.

Installation and operation of the window protective system of this invention should now be apparent. Trained workmen attach the supports 18, 20 above and below the window 14 to be protected. The panels 22, 24 are cut to size. To install the inner or rearward panel 24, it is raised and tilted until the upper end thereof passes into the upper channel 44 between the rear wall 34 and the tapered section 70 of the intermediate wall 32. The panel 24 is raised until the bottom end thereof clears the bottom support 20. The panel 24 is then pivoted until the bottom end thereof is aligned with the channel 48. The panel 24 is then lowered until it is supported by the lower support 20. The outer or forward panel 22 is installed in essentially the same manner, i.e. it is inserted into the upper channel 42 until the lower end thereof clears the lower support 20 and the panel 22 is then pivoted until it is aligned with the lower channel 46. The panel 22 is then lowered into the channel 46 and is thereby supported by the lower support.

Figure 7:
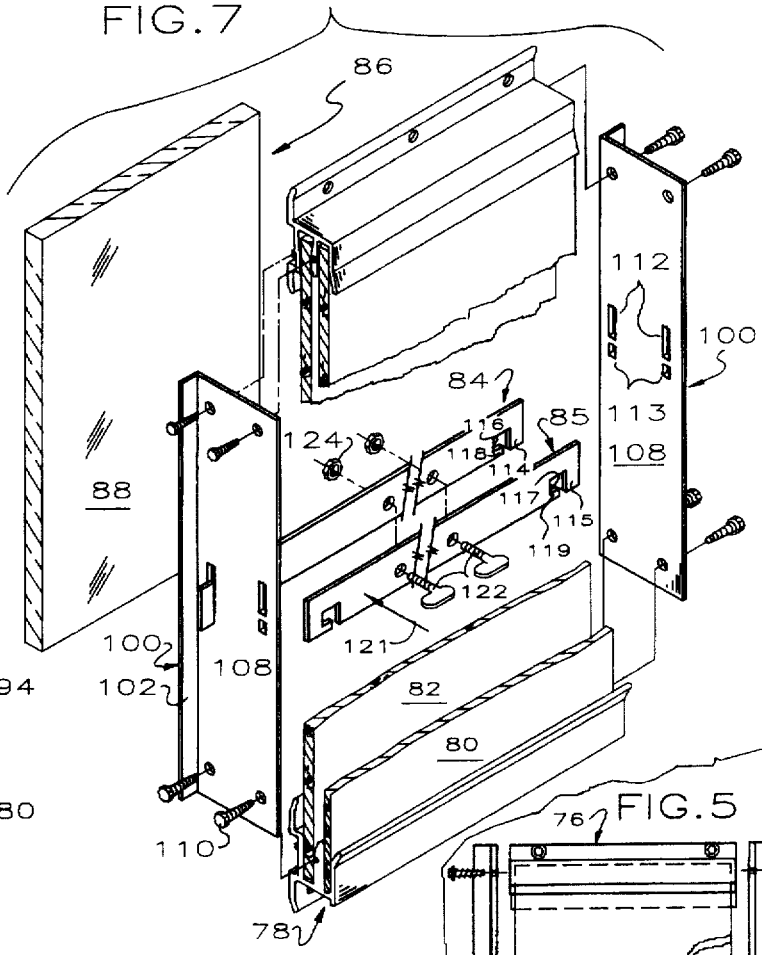
FIG. 7 is an enlarged exploded isometric view of the window protective system of FIGS. 5 and 6.
Figure 6:
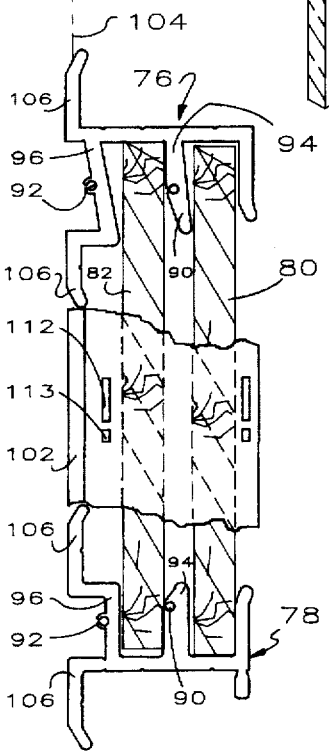
FIG. 6 is an enlarged broken side elevational view of the window protective system of FIG. 5.
Figure 5:
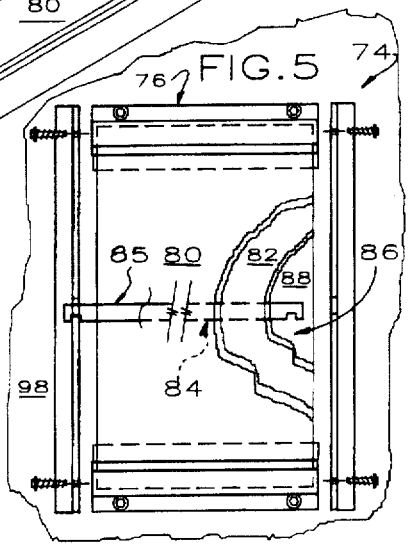
FIG. 5 is a front elevational view of another embodiment of the window protective system of this invention installed over a conventional window.

Referring to FIGS. 5–7, there is illustrated an improved embodiment of a window protective system or installation 74 of this invention comprising, as major components, upper and lower supports 76, 78, a pair of structural panels 80, 82 and a pair of removable support bars 84, 85. The installation 74 protects a conventional window 86 having a glass pane or panel 88.

The upper and lower supports 76, 78 are substantially the same as the supports 18, 20 except for the provision of fastener receiving openings 90, 92 provided by the intermediate and rear walls 94, 96.

The support bars 84, 85 are attached to the building wall 98 by a pair of side rails 100 each of which comprise an angle having a first leg 102 parallel and quite close to a plane 104 defined by the mounting flanges 106 and a second leg 108. Suitable threaded fasteners 110 extend through the second leg 108 into the fastener openings 90, 92 to attach the side rails 100 to the upper and lower supports 76, 78 thereby affixing the side rails 100 to the building wall 98.

The side rails 100 provide two pairs of aligned slots 112 and two pairs of aligned openings 113 immediately below the slots 112. As will be more fully apparent hereinafter, the ends of the support bars 84, 85 are supported and retained in the slots 112 and openings 113. To this end, the support bars 84, 85 each comprise lug shaped ends 114, 115 adjacent rectangular slots 116, 117 opening through the bottom of the bars 84, 85 to provide tangs 118, 119. The ends 114, 115 are sized to pass through the slots 112, the slots 116, 117 are sized and shaped so the edge of the leg 108, adjacent the slots 112, fits into the slots 116, 117 and the tangs 118, 119 are sized and shaped to fit in the openings 113. It will be seen that the slots 116, 117 include an enlarged portion opening through the bottom edge of the bar. It will accordingly be seen that the slots 112, are of sufficient vertical extent to receive the ends of the bars 84, 85 so the slots 112, 116, 117 can mesh and the tangs 118, 119 fit in the openings 113.

As best shown in FIG. 6, one pair of the slots 112 are parallel to the plane 104 and located between the plane 104 and the inner panel 82. Thus, any deflection of the panel 82 toward the window glass 88 is resisted by the support bar 84. To this end, the support bar 84 is desirably configured to resist deflection in the direction shown by the arrow 121. Thus, as shown in FIG. 8, the bar 84 includes a rib 120 extending along the back of the bar 84 for part of the length thereof. As will be apparent to those skilled in the art, the rib 120 stops well short of the ends 114 of the bar 84 and does not interfere with the connection between the bar 84 and the side rails 100.

The second pair of slots 112 are also parallel to the plane 104 and are located outboard of the outer protective panel 80. This has two effects. First, the leg 108 extends outwardly past the outer protective panel 80 so the gap between the inner panel 82 and the window glass 88 is substantially restricted against movement of high velocity winds. Second, the bars 84, 85 are positioned so the panels 80, 82 may be clamped together in the center thereof. The ends of the panels 80, 82 will accordingly be clamped against the intermediate walls 94 to provide a rugged barrier against debris propelled toward the window 86.

It will be seen that the side rails 100 have two functions. First, the side rails 100 support the bars 84, 85 in a position where the bars 84, 85 resist deflection of the panels 80, 82 and specifically resists deflection of the inner panel 82 in the direction shown by the arrow 118. Thus, the bars 84, 85 reduce the unsupported length of the structural panels 80, 82. By placing the bars 84, 85 in a common horizontal plane approximately midway along the height of the panels 80, 82, the unsupported length of the panels 80, 82 is halved. Second, the legs 108 of the side rails 100 substantially decrease the extent to which high velocity wind can get between the panels 80, 82 and the window 86. In this regard, it will seen that the legs 108 of the side rails 100 extend away from the building at least as far, and preferably further, than the outer panel 80. This also minimizes damage under many circumstances. Those skilled in the art will recognize that the system of FIGS. 5–8 is substantially stronger than the system of FIGS. 1–4.

Installation and operation of the window protective system of FIGS. 5–8 should now be apparent. Trained workmen attach the supports 76, 78 above and below the window 86 to be protected, using threaded fasteners extending through those of the flanges 106 that suit the building configuration and by using threaded fasteners extending through the base of the channels. The side rails 100 are attached to the supports 76, 78 with the fasteners 110. The inner bar 84 is installed in the inner set of slots 112 by inserting the bar ends 114 through the slots 112 until the openings to the slots 116 align with the legs 108. The bar 84 is then moved downward until the tangs 118 align with the openings 113 and the bar 84 is then moved to the right in FIG. 7. The panels 80, 82 are cut to size. The panels 80, 82 are installed as in the embodiment of FIGS. 1–4. The outer bar 85 is then installed in the outer set of slots 112 and the bars 84, 85 and panels 80, 82 clamped together, as by the provision of threaded fasteners 122, such as thumb screws or the like, received in nuts 124. Clamping the bars 84, 85 and the panels 80, 82 together in the middle also causes the panel ends to grip the intermediate walls 94 of the supports 76, 78 so the panels 80, 82 are essentially immobile. Clamping the panels 80, 82 together also makes the connection between the bars 84, 85 and the side rails 100 secure. Even without the tangs 118, 119, or even without the sophisticated slot configurations, if the panels 80, 82 are clamped together with the bars 84, 85 in place, the bars 84, 85 cannot move out of engagement with the side rails.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A storm shutter for protecting an opening in a building, comprising first and second supports for attachment to the building on opposite sides of the opening, the first and second supports each comprising at least one panel receiving channel, the at least one channel of the first support and the at least one channel of the second support defining a plane for receiving a first planar protective panel, and means for securing the supports to the building;

first and second planar protective panels, at least one of the panels being for receipt in the at least one channel; and means for clamping the first and second panels together comprising a bar, means for mounting the bar on the building and means for binding the panels to the bar.

2. The storm shutter installation of claim 1 wherein the clamping means comprises a second bar, and means for fastening the bars together, the panels being between the bars.

3. The storm shutter installation of claim 1 wherein the means mounting the bar on the building comprises the first and second supports and wherein the clamping means comprising means for attaching the protective panels to the first and second supports.

4. The storm shutter installation of claim 1 wherein the first and second supports each comprise at least a second panel receiving channel, the second channel of the first support and the second channel of the second support defining a plane for receiving the second protective panel.

5. A storm shutter for protecting an opening in a building, comprising upper and lower supports for attachment to the building above and below the opening, the upper and lower supports each comprising at least one panel receiving channel, the at least one channel of the upper support and the at least one channel of the lower support defining a plane for receiving a first planar protective panel, and means for securing the supports to the building;

first and second planar protective panels, at least one of the panels being for receipt in the at least one channel; and means for clamping the first and second panels together comprising a bar, means for mounting the bar on the building and means for binding the panels to the bar.

6. The storm shutter installation of claim 5 wherein the clamping means comprises a second bar, and means for fastening the bars together, the panels being between the bars.

7. The storm shutter installation of claim 5 wherein the means mounting the bar on the building comprises the upper and lower supports and wherein the clamping means further comprising means for attaching the protective panels to the upper and lower supports.

8. The storm shutter installation of claim 5 wherein the upper and lower supports each comprise at least a second panel receiving channel, the second channel of the upper support and the second channel of the lower support defining a plane for receiving the second protective panel.

9. A storm shutter for protecting an opening in a building, comprising upper and lower supports for attachment to the building above and below the opening, the upper and lower supports each comprising first and second generally parallel channels, the upper first channel and the lower first channel defining a first plane for receiving a first planar protective panel, the upper second channel and the lower second channel defining a second plane for receiving a second planar protective panel, and means for securing the supports to the building defining a third plane for being parallel to the building;

a pair of side rails and means for securing the side rails to the building in a vertical orientation adjacent the opening;

first and second planar protective panels for receipt in the first and second channels;

a first support bar and means for positioning the first support bar on the side rails at a location intermediate the upper and lower supports, the first support bar being located between the third plane and an innermost of the protective panels;

a second support bar and means for positioning the second support bar on the side rails at a location intermediate the upper and lower supports, the first and second protective panels being positioned between the support bars; and means for clamping the support bars and the protective panels together.

10. The storm shutter installation of claim 9 wherein each of the side rails including a section for extending between the building and the panels for restricting air movement between the protective panels and the building.

11. The storm shutter installation of claim 10 wherein the side rail sections extend beyond the protective panels.

12. The storm shutter installation of claim 9 wherein the side rails include aligned first and second slots and wherein each bar includes ends, a bottom edge and a third slot, adjacent each end, opening through the bottom edge, each bar being attached to the side rails by the first, second and third slots.

13. The storm shutter installation of claim 12 wherein the side rails include first and second openings adjacent the first and second slots and wherein the third slot includes an enlarged portion and a section opening between the enlarged portion and the bottom edge of the bar, each bar end defining a tang between the enlarged slot portion and the section opening, the tang being received in the first and second openings.

14. The storm shutter installation of claim 13 wherein the first slot is vertically above the first opening and the second slot is vertically above the second opening.

15. The storm shutter of claim 9 wherein the support bars reside in a common horizontal plane.

16. The storm shutter of claim 9 wherein the upper and lower supports each comprise an intermediate wall between the first and second channels, the clamping means comprising means for clamping the protective panels to the intermediate walls.

17. The storm shutter installation of claim 9 wherein the means for securing the supports to the building comprises a plurality of flanges defining the third plane and wherein the upper and lower supports each comprise a base, a rear wall for position adjacent the building, an intermediate wall and a front wall defining the first and second channels, the rear and intermediate walls defining an innermost of the channels, the intermediate and front walls defining an outermost of the channels, the intermediate walls of the upper and lower supports including a first inner section extending from the base generally parallel to the third plane and a second outer section extending from the inner section and defining an acute angle with the third plane, the second section facilitating movement of an innermost of the panels into the innermost channel.

18. The storm shutter installation of claim 9 wherein the panels are of a transparent plastic material.

19. The storm shutter installation of claim 9 wherein the means for clamping the support bars and the protective panels together clamps the support bars and the protective panels to the upper and lower supports.

* * * * *